US009051828B2

(12) United States Patent
Gould et al.

(10) Patent No.: US 9,051,828 B2
(45) Date of Patent: Jun. 9, 2015

(54) THERMALLY ASSISTED GRAVITY DRAINAGE (TAGD)

(75) Inventors: Bryan Gould, Calgary (CA); Ian Atkinson, Calgary (CA); Bruce Roberts, Calgary (CA); Doug Beattie, Calgary (CA); Stephen D. Crane, Richardson, TX (US); Arthur Hale, Angleton, TX (US); Tarek Hamida, Calgary (CA); Neeraj Patel, Edmonton (CA)

(73) Assignee: Athabasca Oil Sands Corp., Calgary, Alberta (CA)

( * ) Notice: Subject to any disclaimer, the term of this patent is extended or adjusted under 35 U.S.C. 154(b) by 462 days.

(21) Appl. No.: 13/163,009

(22) Filed: Jun. 17, 2011

(65) Prior Publication Data

US 2012/0318512 A1 Dec. 20, 2012

(51) Int. Cl.

| | |
|---|---|
| ***E03B 3/11*** | (2006.01) |
| ***E21B 36/00*** | (2006.01) |
| ***E21B 43/24*** | (2006.01) |

(52) U.S. Cl.

CPC ..... *E21B 43/24* (2013.01)

(58) Field of Classification Search

USPC ..... 166/302, 57, 60, 61, 245, 50; 392/301, 392/306

See application file for complete search history.

(56) References Cited

U.S. PATENT DOCUMENTS

| | | | | |
|---|---|---|---|---|
| 7,004,247 | B2 * | 2/2006 | Cole et al. | 166/60 |
| 7,562,706 | B2 | 7/2009 | Li et al. | |
| 7,673,681 | B2 | 3/2010 | Vinegar et al. | |
| 7,677,310 | B2 | 3/2010 | Vinegar et al. | |
| 7,681,647 | B2 | 3/2010 | Mudunuri et al. | |
| 8,381,815 | B2 | 2/2013 | Karanikas et al. | |
| 2011/0048717 | A1 | 3/2011 | Diehl et al. | |

* cited by examiner

*Primary Examiner* — Kenneth L Thompson
(74) *Attorney, Agent, or Firm* — Jackson Walker, LLP

(57) ABSTRACT

A system and method for producing bitumen or heavy oil from a clastic or carbonate reservoir. The mobility of the bitumen or heavy oil is increased by conductive heating to reduce the viscosity. The bitumen or heavy oil is heated to temperatures below the thermal cracking temperature of the bitumen or heavy oil. As the bitumen or heavy oil is produced, evolved gases or evaporated connate water or both form a gas chamber which acts to replace the volume of the produced fluid required for the gravity drainage process.

45 Claims, 14 Drawing Sheets

3 Years

Temperature

Viscosity

Gas Saturation

7 Years

Temperature

Viscosity

Gas Saturation

10 Years

Temperature

Viscosity

Gas Saturation

THERMALLY ASSISTED GRAVITY DRAINAGE (TAGD)

FIELD

The present disclosure relates generally to recovery of hydrocarbons. More particularly, the present disclosure relates to thermal recovery of bitumen or heavy oil.

BACKGROUND

The publications listed below are examples of hydrocarbon recovery processes.

U.S. Pat. No. 7,673,681 issued on Mar. 9, 2010 to Vinegar et al.

U.S. Publication No. 2011/0048717 published on Mar. 3, 2011 to Diehl et al.

PCT Publication No. WO 2010/107726 published on Sep. 23, 2010 to Al-Buraik.

Canadian Patent No. 2120851 issued on Aug. 22, 1995 to Yu et al.

It is, therefore, desirable to provide systems and methods of thermal recovery of bitumen or heavy oil.

SUMMARY

It is an object of the present disclosure to obviate or mitigate at least one disadvantage of previous hydrocarbon recovery processes.

In a first aspect, the present disclosure provides a method of producing bitumen or heavy oil from a reservoir including:

providing a heater well in a first portion of the reservoir;

providing a producer well in a second portion of the reservoir, the second portion being at a greater depth than the first portion;

providing a reservoir heater in the heater well;

operating the reservoir heater to conductively heat the reservoir and reduce the viscosity of the bitumen or heavy oil; and producing bitumen or heavy oil through the producer well.

In an embodiment, the method further includes providing a reservoir producer heater in the producer well and operating the reservoir producer heater to conductively heat the reservoir and reduce the viscosity of the bitumen or heavy oil.

In an embodiment, the method further includes providing a flow assurance heater in the producer well and operating the flow assurance heater to facilitate flow of bitumen or heavy oil in the producer well.

In an embodiment, the reservoir is heated to an average temperature of less than 300° C.

In an embodiment, the reservoir is heated to an average temperature of less than 250° C.

In an embodiment, the reservoir is heated to an average temperature of less than 200° C.

In an embodiment, the reservoir is heated to an average temperature of less than the thermal cracking temperature of the bitumen or heavy oil in the reservoir at reservoir conditions.

In an embodiment, the reservoir is heated to a temperature less than the saturated steam temperature at reservoir conditions.

In an embodiment, the reservoir is heated to an average temperature of between about 120° C. and about 160° C.

In an embodiment, the reservoir is heated to an average temperature of between about 135° C. and about 145° C.

In an embodiment, the reservoir is a clastic reservoir.

In an embodiment, the reservoir is a carbonate reservoir.

In an embodiment, the reservoir is a dolomite carbonate reservoir.

In an embodiment, the reservoir is a limestone carbonate reservoir.

In an embodiment, the reservoir is a karsted carbonate reservoir.

In an embodiment, the reservoir is a vuggy carbonate reservoir.

In an embodiment, the reservoir is a moldic carbonate reservoir.

In an embodiment, the reservoir is a fractured carbonate reservoir.

In a further aspect, the present disclosure provides a method of producing bitumen or heavy oil from a reservoir including:

providing a heater well in a first portion of the reservoir;

providing a producer well in a second portion of the reservoir, the second portion being at a greater depth than the first portion;

heating the heater well to conductively heat the reservoir and reduce the viscosity of the bitumen or heavy oil; and producing bitumen or heavy oil through the producer well.

In an embodiment, the method further includes heating the producer well to conductively heat the reservoir and reduce the viscosity of the bitumen or heavy oil.

In an embodiment, the method further includes heating the producer well to facilitate flow of bitumen or heavy oil in the producer well.

In an embodiment, the method further includes selecting a target average temperature and reducing heating of the heater well once the average temperature of the reservoir is substantially equal to the target average temperature to maintain the average temperature of the reservoir at the target average temperature without increasing the average temperature of the reservoir.

In an embodiment, the method further includes selecting a target average temperature and reducing heating of the heater well once the average temperature of the reservoir is substantially equal to the target average temperature to maintain the average temperature of the reservoir at the target average temperature without increasing the average temperature of the reservoir, and the target average temperature is between about 120° C. and about 160° C.

In an embodiment, the method further includes selecting a target average temperature and reducing heating of the heater well once the average temperature of the reservoir is substantially equal to the target average temperature to maintain the average temperature of the reservoir at the target average temperature without increasing the average temperature of the reservoir, and the target average temperature is between about 135° C. and about 145° C.

In an embodiment, the method further includes controlling pressure during production to prevent an increase in pressure.

In an embodiment, the method further includes controlling pressure during production to prevent an increase in pressure by drawing down pressure from the reservoir.

In a further aspect, the present disclosure provides a system for producing bitumen or heavy oil from a reservoir comprising:

a heater well in a first portion of the reservoir;

a producer well in a second portion of the reservoir, the second portion being at a depth greater than the first portion; and a heater in the heater wellbore for heating the reservoir.

In an embodiment, the system further includes a second heater in the producer wellbore for heating the reservoir.

In an embodiment, the system further includes a second heater in the producer wellbore for heating bitumen or heavy oil produced from the reservoir to maintain a selected viscosity of the bitumen or heavy oil in the producer well.

In an embodiment, the heater is an electric resistance heater.

In an embodiment, the heater is an electric resistance heater cable heater.

In an embodiment, the heater is a fluid exchange heater.

In a further aspect, the present disclosure provides a method of producing bitumen or heavy oil from a reservoir including conductively electrically heating the reservoir to lower the viscosity of bitumen or heavy oil in the reservoir, forming a mobilized column of bitumen or heavy oil; and producing the bitumen or heavy oil below the mobilized column of bitumen or heavy oil.

In an embodiment, the method further includes heating an upper portion of the reservoir, the upper portion of the reservoir laterally offset from the mobilized column.

Other aspects and features of the present disclosure will become apparent to those ordinarily skilled in the art upon review of the following description of specific embodiments in conjunction with the accompanying figures.

BRIEF DESCRIPTION OF THE DRAWINGS

Embodiments of the present disclosure will now be described, by way of example only, with reference to the attached Figures.

DETAILED DESCRIPTION

Generally, the present disclosure provides a process, method, and system for recovering hydrocarbons from a reservoir.

Thermal Assisted Gravity Drainage (TAGD)

Thermal Assisted Gravity Drainage (TAGD) is an in situ recovery process for production of viscous hydrocarbons such as bitumen or heavy oil. Less viscous hydrocarbons may be produced with the bitumen or heavy oil. TAGD is applicable to production of bitumen or heavy oil from either clastic or carbonate reservoirs. Carbonate reservoirs include limestone or dolomite, and may be any combination of vuggy, moldic, karsted, or fractured. More generally, TAGD is applicable to any formation wherein it is advantageous to transfer thermal energy to the formation.

Figure 1:
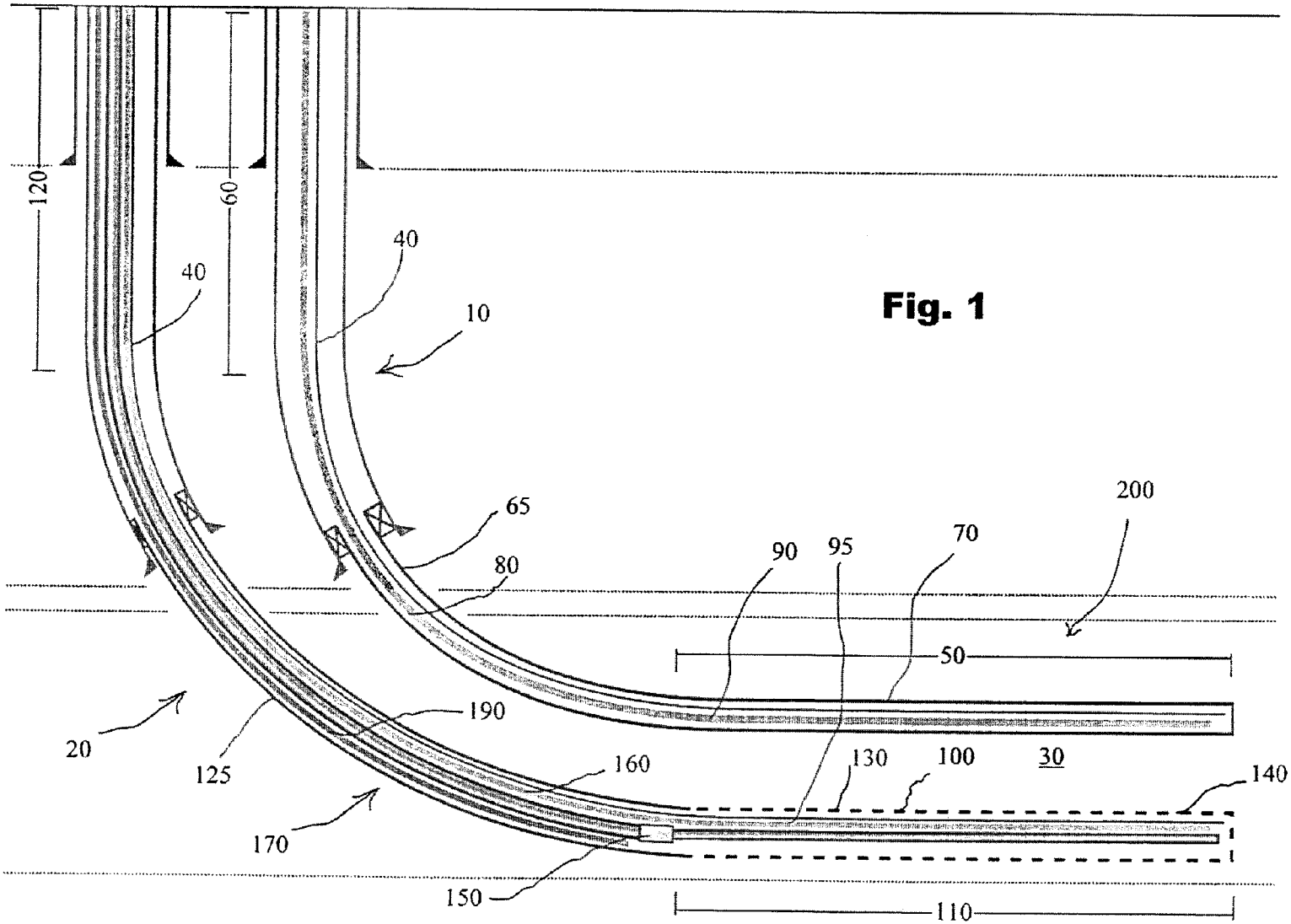
FIG. 1 is a schematic of a heater well and a producer well arranged in a TAGD pattern.

FIG. 1 is a schematic of a heater well 10 and a producer well 20 (collectively "wells") arranged in a TAGD pattern in a bitumen or heavy oil reservoir 30. As used herein, the reservoir 30 refers to that portion of a bitumen or heavy oil reservoir within a pattern as defined below (for example the first pattern 200, second pattern 260, or third pattern 270 of FIGS. 3 to 5, respectively).

The producer well 20 is located below the heater well 10 and may be located near the base of the reservoir 30. The heater well 10 may be between about 5 m and about 15 m above the producer well 20. An instrument string 40 may be present within each of the wells. The instrument string 40 may include a pressure sensor, a temperature sensor, both, or other instruments.

The heater well 10 includes a substantially horizontal heater well section 50 and a substantially vertical heater well section 60 joined by a heater well heel 65. The substantially vertical heater well section 60 joins the substantially horizontal heater well section 50 with a wellhead (not shown). The substantially horizontal heater well section 50 includes a heating zone 70. The heating zone 70 may have a length substantially equal to the length of the substantially horizontal heater well section 50. In one illustrative example, the heating zone 70 is about 1600 m in length. The heater well 10 is cased and hydraulically isolated from the reservoir 30.

A reservoir heater 80 is located in the heater well 10. The reservoir heater 80 includes a heating section 90 for transferring thermal energy to the reservoir 30. The heating section 90 defines the heating zone 70. In one illustrative example, the heating section 90 is about 1600 m in length.

The producer well 20 includes a substantially horizontal producer well section 110 and a vertical producer well section 120 joined by a producer well heel 125. The vertical producer well section 120 joins the substantially horizontal producer well section 110 with a wellhead (not shown). The substantially horizontal producer well section 110 includes a production zone 130. The producer well 20 is cased and hydraulically isolated from the reservoir 30 except at the production zone 130. The producer well 20 is completed in the production zone 130 with, for example, perforations, screens, a slotted liner 140 or other fluid inlet in the production zone 130. An artificial lift system, for example a pump 150, such as a rod pump, progressing cavity pump, or electric submersible pump, is provided in the producer well 20 to carry bitumen or heavy oil to the surface.

A reservoir producer heater 160 may be present in the producer well 20. A producer well 20 including a reservoir producer heater 160 functions as both a producer well 20 and a heater well 10, and is referred to below as a heater producer well 170. The reservoir producer heater 160 performs the same functions as the reservoir heater 80, providing thermal energy to the reservoir 30 along a producer heater heating section 95. The producer heater heating section 95 defines a producer heating zone 100. The producer heating zone 100 and the production zone 130 may be co-extensive. The producer heating zone 100 may have a length substantially equal to the length of the substantially horizontal producer well section 110. In one illustrative example, the producer heating zone 100 is about 1600 m in length.

A flow assurance heater 190 may be present in the vertical producer well section 120. The flow assurance heater 190 facilitates flow of bitumen or heavy oil within the producer well 20 by maintaining the temperature (and thus limiting the viscosity) of the bitumen or heavy oil. Thermal energy output of the flow assurance heater 190 may be uniform per unit length from the producer well heel 125 to the wellhead. The heater producer well 170 may include both the reservoir producer heater 160 and the flow assurance heater 190. A producer well 20 including the flow assurance heater 190 but lacking the reservoir producer heater 160 is not a heater producer well 170.

Each of the reservoir heater 80, the reservoir producer heater 160, and the flow assurance heater 190 (collectively "heaters") may be of any type adapted for use in a well. Any of the heaters may be elongate to facilitate placement in the wells. Any of the heaters may be an electric resistance heater, for example a mineral insulated three-phase heater, for example a rod heater or cable heater. The electric resistance heater may be capable of accommodating medium voltage levels, for example from 600 V to 4160 V phase to phase.

Any of the heaters may be a heat exchanger that transfers thermal energy to the reservoir 30 by circulation of heat transfer fluid such as hot water, steam, oil (including synthetic oil), molten salts, or molten metals.

Heating

Thermal energy is transferred from the reservoir heater 80 or reservoir producer heater 160 to the reservoir 30 by conductive heating. The reservoir 30 is heated to an average temperature at which the viscosity of heavy oil or bitumen is low enough for the heavy oil or bitumen to flow by gravity to the producer well 20 or heater producer well 170. The viscosity of bitumen or heavy oil may be lowered, for example, to between about 50 cP and about 200 cP.

Figure 2:
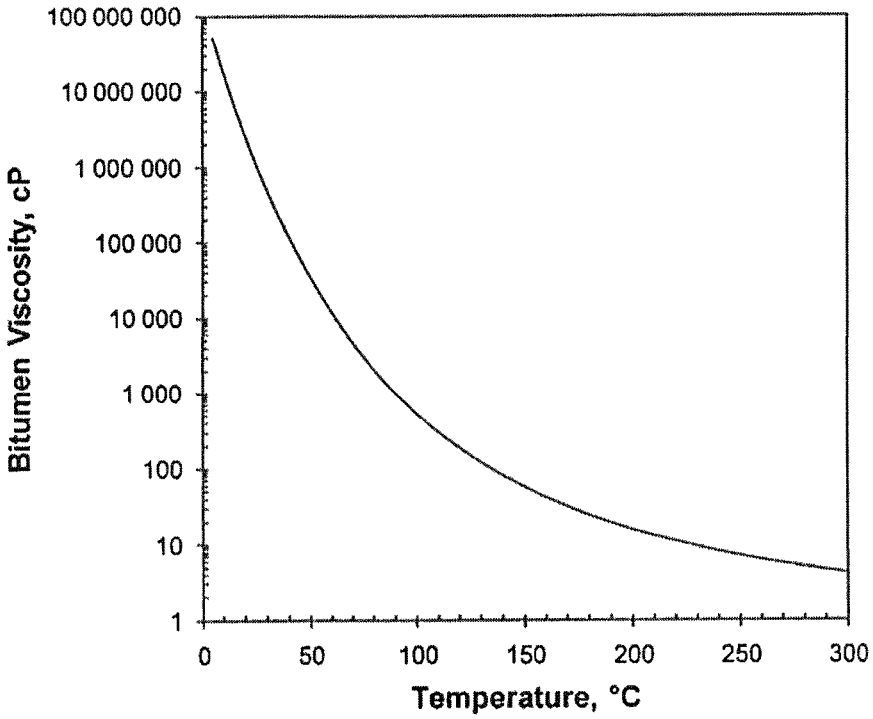
FIG. 2 is a plot of viscosity as a function of temperature for Leduc bitumen.

FIG. 2 is a plot of the viscosity of Leduc bitumen versus temperature. The data in FIG. 2 was applied to a simulation prepared with a commercially-available reservoir simulator (Computer Modeling Group (CMG)-STARS). A significant decrease in viscosity of Leduc bitumen occurs when the temperature of the bitumen is increased from 11° C. to between about 120° C. and about 160° C. Dead oil viscosity is reduced from about 14 million cP at an initial reservoir temperature of 11° C. to about 80 cP at 140° C. At 140° C., the bitumen or heavy oil is sufficiently mobile to drain downward to the producer well 20 or heater producer well 170 by gravity.

The reservoir heater 80 and the reservoir producer heater 160 are operated to transfer sufficient thermal energy to the reservoir 30 to increase the average temperature of the reservoir 30 to a target average temperature of between about 120° C. and about 160° C. While the reservoir 30 as a whole may average between about 120° C. and about 160° C., there may be near heater zones 180 (See for example FIG. 7) of the heater wells 10 and heater producer wells 170 with an average temperature of up to about 250° C. The near heater zones 180 are modeled as one meter blocks extending along the length of the heating zone 70, and for a heater producer well 170, at least a portion of the production zone 130.

TAGD may be applied to raise the average temperature of the reservoir 30 to between about 120° C. and about 160° C. An average temperature of about 140° C. provided favourable economics. At significantly lower average temperatures, for example about 100° C., production rates are too low to be economical. At significantly higher average temperatures, for example about 180° C., the resulting increase in the production rate does not justify the required increase in energy input required to raise the reservoir 30 to the higher average temperature. In addition, heating the reservoir 30 to between about 120° C. and about 160° C. avoids other potentially undesirable effects associated with higher average temperatures, such as increased $H_2S$ or $CO_2$ production, and in some cases, thermal cracking of bitumen or heavy oil.

During heating, the reservoir pressure may be monitored and controlled. Pressure may be controlled to remain below a selected value by reducing transfer of thermal energy to the reservoir 30 or by producing bitumen, heavy oil, water, vapours, or other fluids from the reservoir 30.

Well Spacing

The spacing of the heater wells 10 and producer wells 20 is set to realize the economical production of hydrocarbons. Substantially horizontal substantially horizontal heater well sections 50 may be spaced as close as between about 5 m and about 40 m apart from each other and from substantially horizontal producer well section 110. The following performance metrics are relevant to optimization of the spacing of the heater wells 10 and producer wells 20: oil production profile (oil production rate versus time), overall recovery factor (fraction of original oil in place (OOIP) produced), energy ratio (ratio of energy supplied to the reservoir 30 to the heating value of the produced bitumen or heavy oil), and capital cost.

Figure 3:
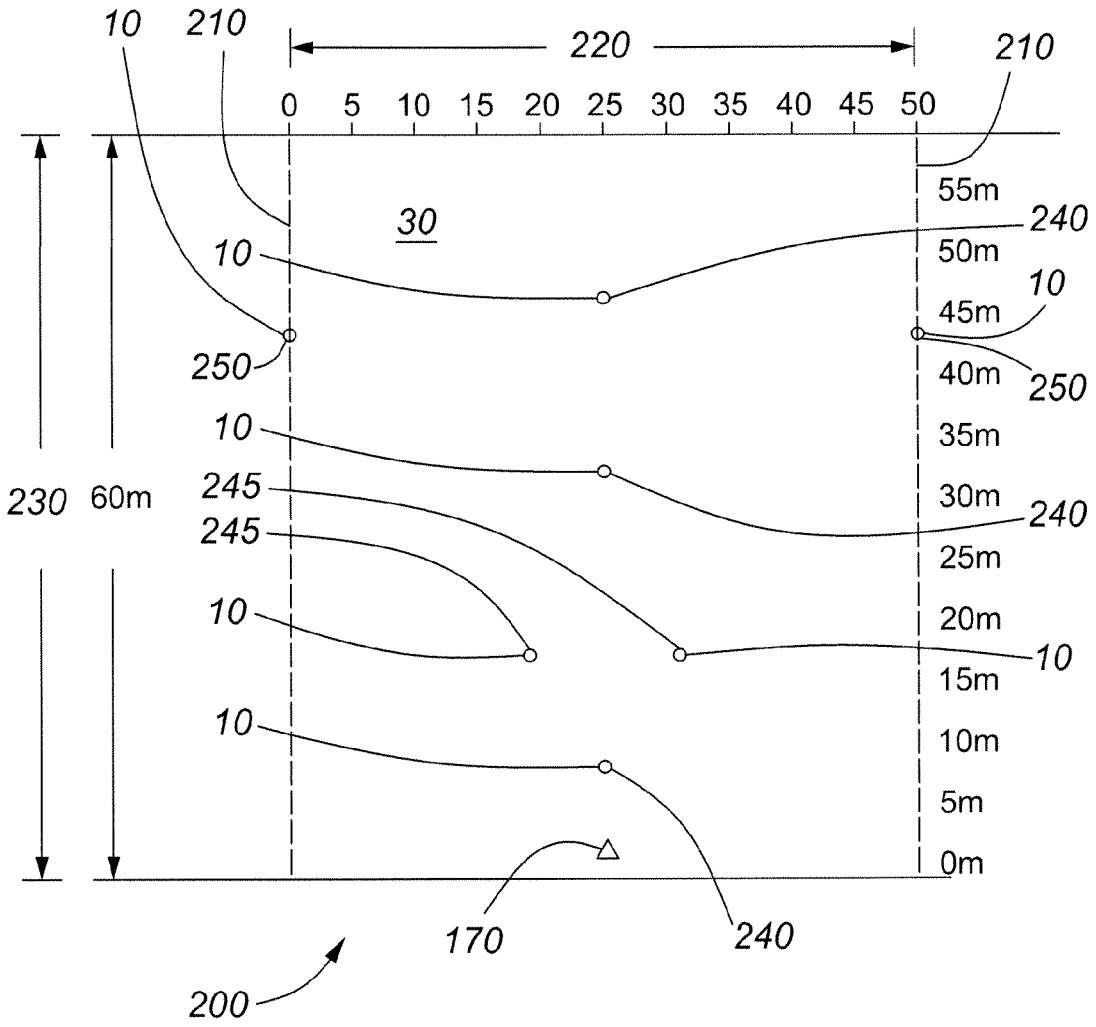
FIG. 3 is a cross-section of a first pattern with a 60 m thick pay zone.
Figure 4:
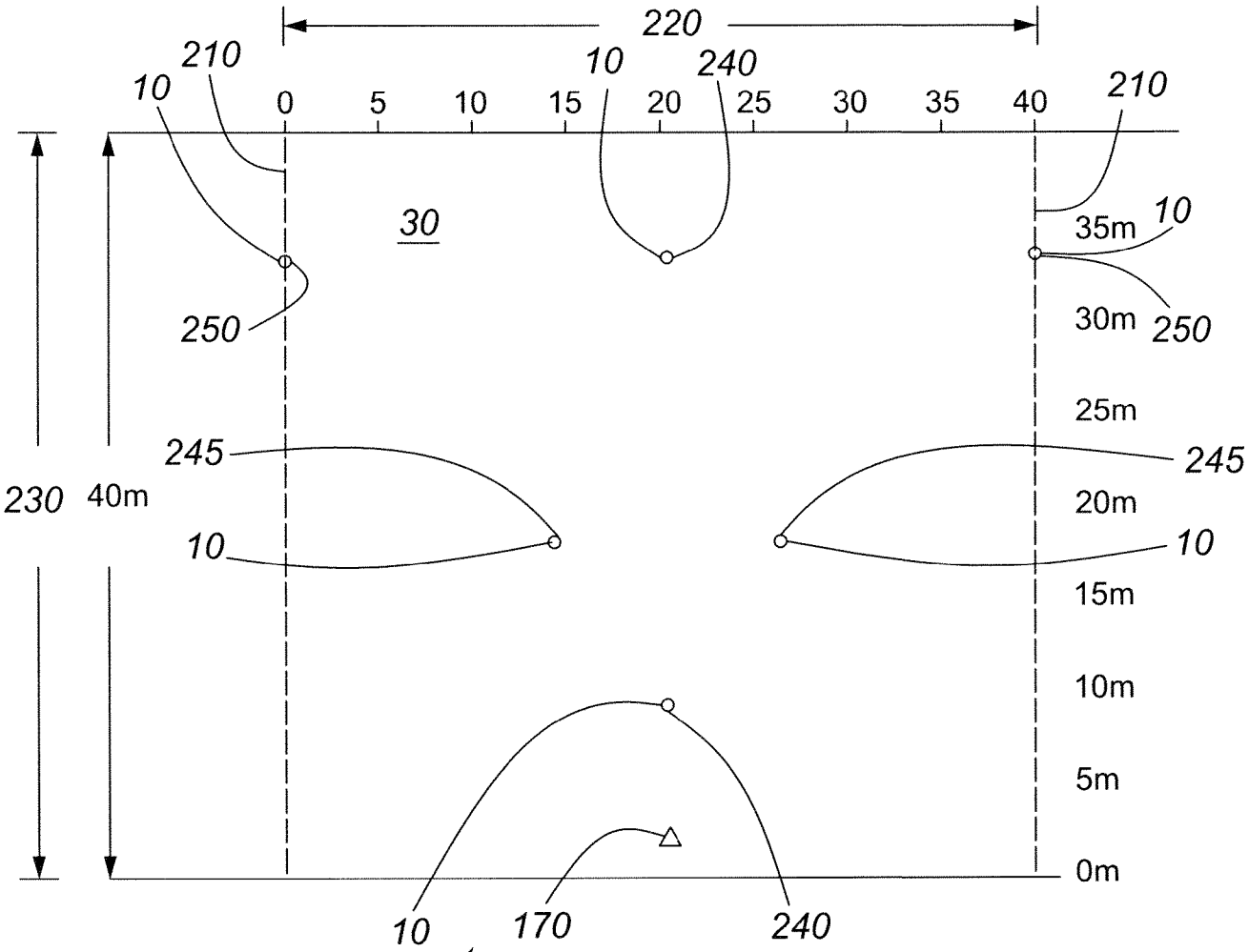
FIG. 4 is a cross-section of a second pattern with a 40 m thick pay zone.
Figure 5:
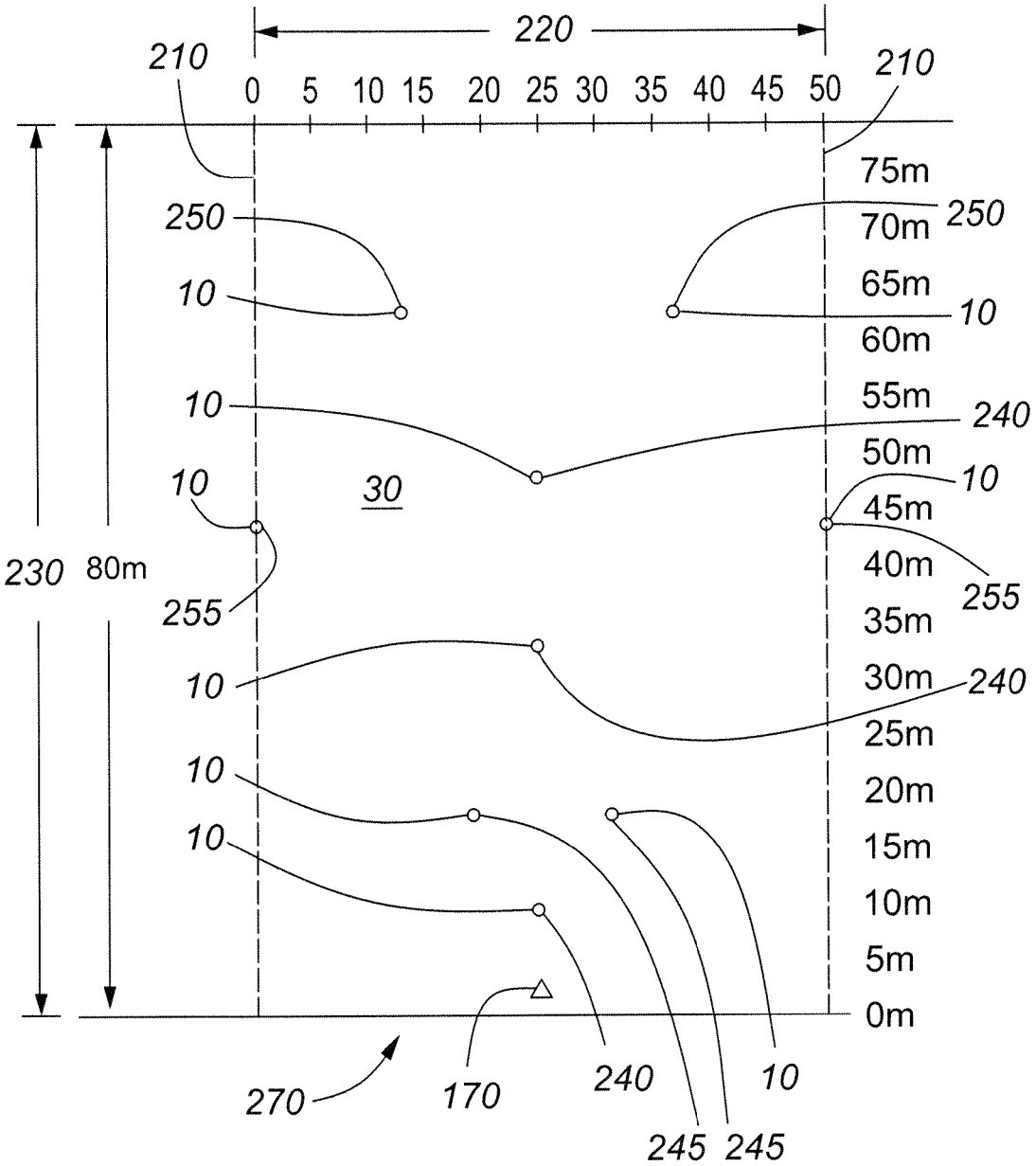
FIG. 5 is a cross-section of a third pattern with an 80 m thick pay zone.

FIGS. 3 to 5 are cross-sections of patterns. Each pattern has a pay thickness 230 and a pattern width 220, and is defined by a no-flow boundary 210 at each end of the pattern width 220. The number of heater wells 10 and their respective locations relative to each other and to the heater producer well 170 may be varied to account for features of the reservoir 30 including pay thickness 230, vertical and horizontal permeabilities, well length, heater power output and temperature, and cost of wells and surface facilities.

FIG. 3 is a cross section of a first pattern 200. The pattern width 220 is 50 m and the pay zone 230 is 60 m thick. Six heater wells 10 and one heater producer well 170 are arranged in five rows in the first pattern 200. The heater wells 10 include aligned heater wells 240 above and substantially laterally aligned with the heater producer well 170. The heater wells 10 also include first offset heater wells 245 above and laterally offset from the heater producer well 170. The heater wells 10 also include second offset heater wells 250 above and laterally offset from the heater producer well 170 (with one half of a second offset heater well 250 at each no-flow boundary 210). The second offset heater wells 250 are laterally offset from the heater producer well 170 to a greater extent than the first offset heater wells 245.

The number of wells, the locations of the wells in the first pattern 200, and the heating output of the heaters were adjusted to obtain a high net present value. The simulation was based on the reservoir 30 and well properties indicated in Table 1.

TABLE 1

| Property | Quantity | Unit |
|---|---|---|
| Vertical Permeability | 2200 | mDarcy |
| Horizontal Permeability | 1100 | mDarcy |
| Porosity | 15 | % |
| Pay thickness | 60 | m |
| Pressure at top of reservoir (absolute) | 473 | kPa |
| Initial reservoir temperature | 11 | ° C. |
| Bitumen saturation | 88 | % |
| Water Saturation | 12 | % |
| Irreducible Water Saturation | 10 | % |
| Viscosity at 11° C. | $14 \times 10^6$ | cP |
| Viscosity at 140° C. | 80 | cP |
| Reservoir Heater Power output | 650 | W/m |
| Reservoir Producer Heater Power output | 150 | W/m |
| Rock Heat capacity at 11° C. | $2.41 \times 10^6$ | $J/(m^3 \cdot °C.)$ |
| Rock Heat capacity at 140° C. | $2.88 \times 10^6$ | $J/(m^3 \cdot °C.)$ |
| Rock Thermal conductivity at 11° C. | 4.6 | W/(m · K) |
| Rock Thermal conductivity at 140° C. | 3.7 | W/(m · K) |
| Bottomhole pressure (absolute) | 500 | kPa |

For a reservoir 30 with the pay zone 230 being thinner or thicker than the 60 m of FIG. 3, rows of wells may be respectively added or removed. Similarly, the lateral offset of first offset heater wells 245 or second offset heater wells 250 (or third offset heater wells 255—FIG. 5, or any offset heater wells generally) may be adjusted to account for a reservoir 30 with the thickness 220 being greater or less than the 50 m of FIG. 3.

FIG. 4 is a cross section of a second pattern 260. The pattern width 220 is 40 m and the pay zone 230 is 40 m thick. Five heater wells 10 and one heater producer well 170 are arranged in four rows. The heater wells 10 include aligned heater wells 240, first offset heater wells 245 and second offset heater wells 250 (with one half of a second offset heater well 250 at each no-flow boundary 210).

FIG. 5 is a cross section of a third pattern 270. The pattern width 220 is 50 m and the pay zone 230 is 80 m thick. Eight heater wells 10 and one heater producer well 170 are arranged in six rows. The heater wells 10 include aligned heater wells 240, first offset heater wells 245 and second offset heater wells 250. The heaters wells further include third offset heater wells 255 (with one half of a third offset heater well 255 at each no-flow boundary 210). The third offset heater wells 255 are laterally offset from the heater producer well 170 to a greater extent than the second offset heater wells 250.

Conductive Heating

Conductive heating provides for more uniform temperature distribution in the reservoir 30 relative to convective heating processes such as those dependent on steam injection. The greater uniformity provides greater predictability of the temperature distribution. As a result, a TAGD pattern may be more easily optimized for a particular set of reservoir conditions than a pattern for a recovery process based on convective heating, for example steam assisted gravity drainage (SAGD) or cyclic steam stimulation (CSS). The number of wells and spacing between wells may be adjusted to account for differences between individual reservoirs with respect to the thicknesses, permeabilities, pressures, temperatures, and other properties of the reservoirs, but the presence of obstacles does not introduce as much uncertainty as in processes based on convective heating.

In reservoirs having impermeable or semi-impermeable barriers, such as shale extending across portions of the reservoir, the vertical growth of a SAGD or CSS steam chamber may be impeded by the barriers. However, thermal energy transfer by conductive heating as in the present disclosure may pass through or around the barriers, mitigating the impact of the barriers on production, recovery, or both.

Production

Production may be described as occurring in three general stages: a ramp-up stage, a peak production stage, and a production decline stage. FIGS. 6 to 17 are plots of simulation data for the first pattern 200 of FIG. 3 at each of the stages wherein the heating zones 70 and the producer heating zones 100 each extend along a substantially horizontal well length of 1600 m. In an embodiment, the bitumen or heavy oil produced from the reservoir 30 is produced substantially as a liquid via the pump 150. In an embodiment, there is no appreciable vapourization of bitumen or heavy oil in the reservoir 30 or the near heater zone 180, or both.

Ramp-Up Stage

Figure 6:
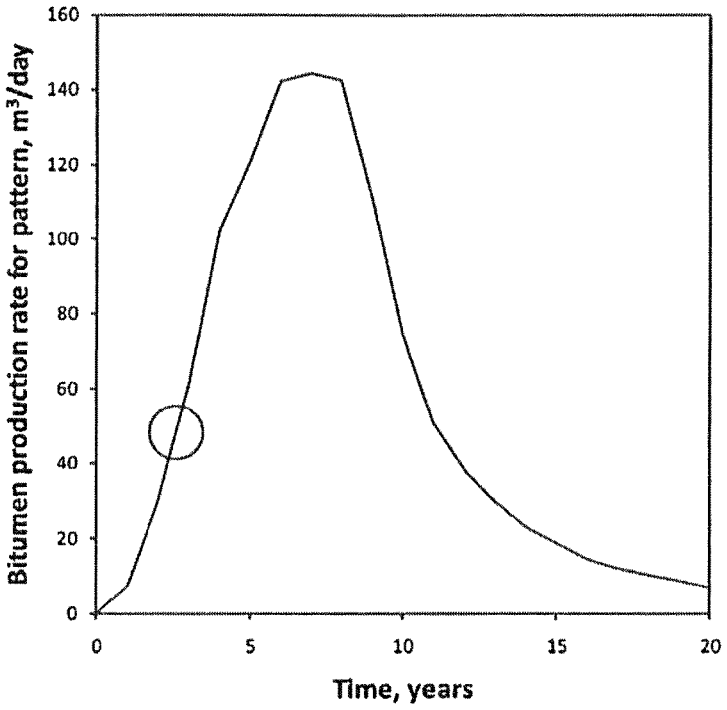
FIG. 6 is a plot of the bitumen production rate from a simulation of the pattern of FIG. 3 versus time with a portion of a ramp-up stage indicated at about 3 years.
Figure 7:
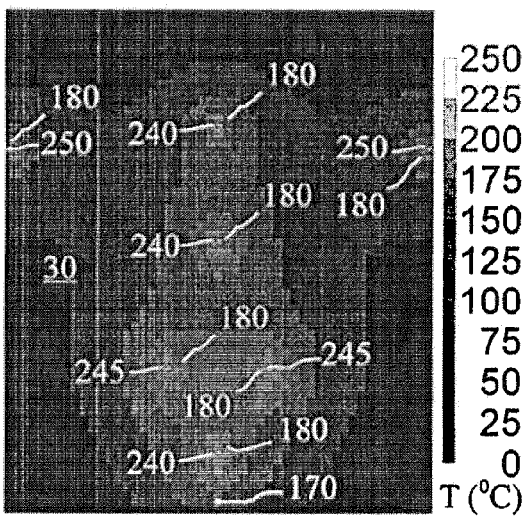
FIG. 7 is a plot of temperature in the pattern of FIG. 3 at 3 years.
Figure 8:
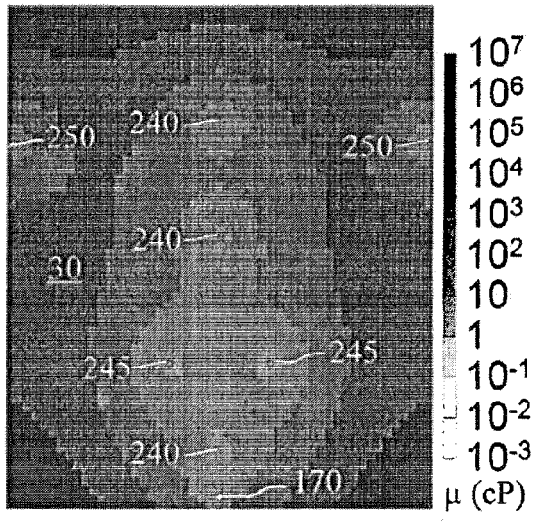
FIG. 8 is a plot of viscosity in the pattern of FIG. 3 at 3 years.
Figure 9:
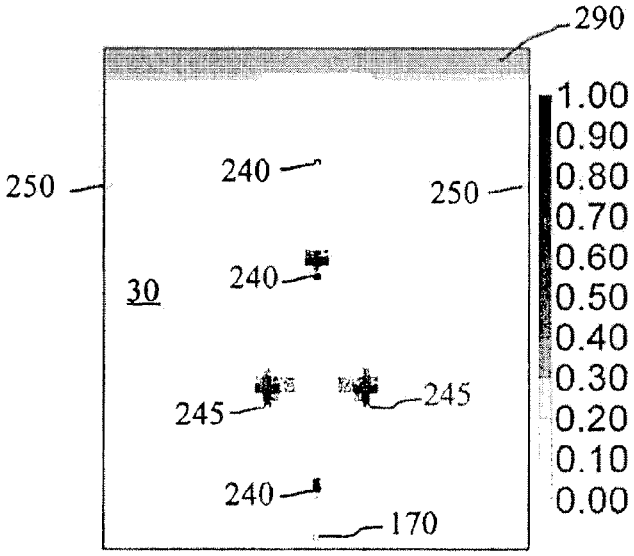
FIG. 9 is a plot of gas saturation in the pattern of FIG. 3 at 3 years.

FIG. 6 is a plot of the bitumen production rate versus time for the simulation with a portion of the ramp-up stage indicated at about 3 years. FIGS. 7 to 9 are respectively plots of temperature, viscosity, and gas saturation distributions in the reservoir 30 with the first pattern 200 at 3 years into the simulation.

Figure 12:
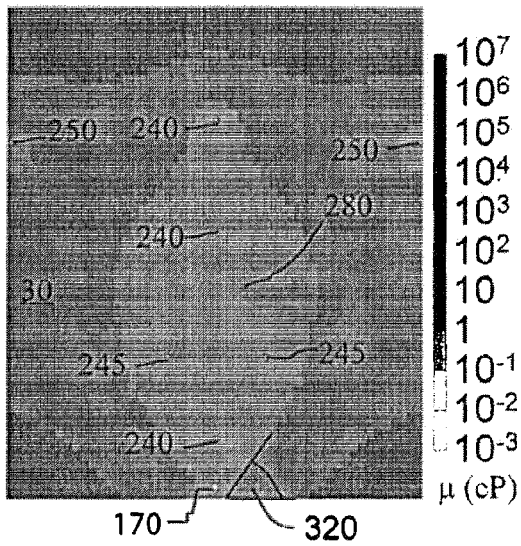
FIG. 12 is a plot of viscosity in the pattern of FIG. 3 at 7 years.

The temperature distribution ranges from about 12° C. in the majority of the reservoir 30 to about 250° C. at the near heater zones 180. During the ramp-up stage (from start-up to about two years of heating), significant increases in temperature that result in a portion of the reservoir 30 reaching the target average temperature of between about 120° C. and about 160° C. primarily occur in the vicinity of the near heater zones 180. The viscosity in the reservoir 30 ranges from 1000 cP or greater in the majority of the reservoir 30 to about 10 cP in the near heater zones 180. Initial bitumen production is from a relatively small volume of heated bitumen in the vicinity of the heater producer well 170. The gas saturation ranges from 0 in the majority of the reservoir 30 to about 0.4 at the lowermost aligned heater well 240 and in a gassy-bitumen zone 290. A mobilized column 280 of connected mobile bitumen that connects the aligned heater wells 240, the first offset heater wells 245, and the producer well 20 has yet to form (FIG. 12).

As time passes and the reservoir 30 is heated further, the average temperature of the reservoir 30 increases, the viscosity of bitumen in the reservoir 30 decreases, and a gas chamber 300 (FIG. 13) forms and expands generally upwards.

Peak Production Stage

Figure 10:
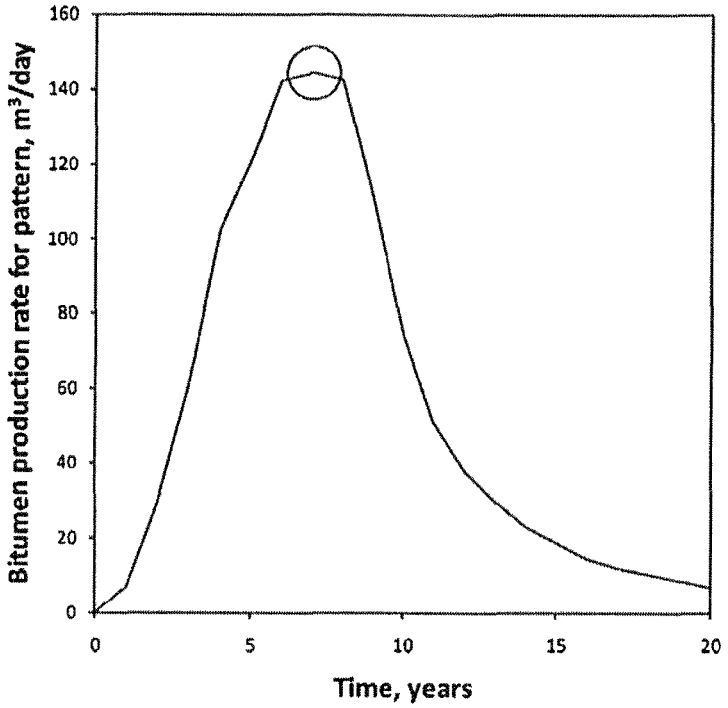
FIG. 10 is a plot of the bitumen production rate versus time with a portion of a peak production stage indicated at about 7 years.
Figure 11:
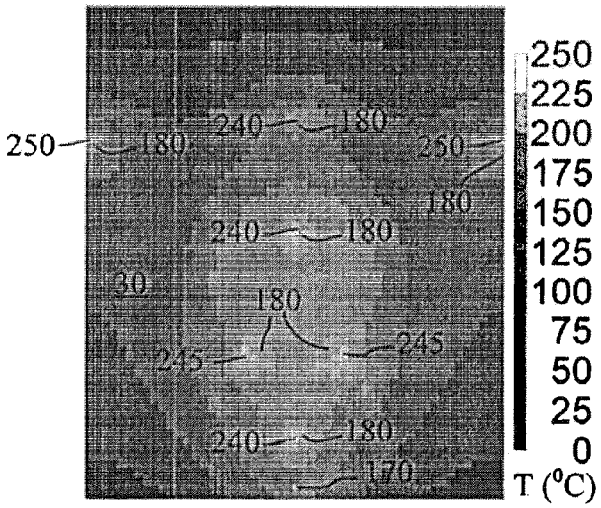
FIG. 11 is a plot of temperature in the pattern of FIG. 3 at 7 years.
Figure 13:
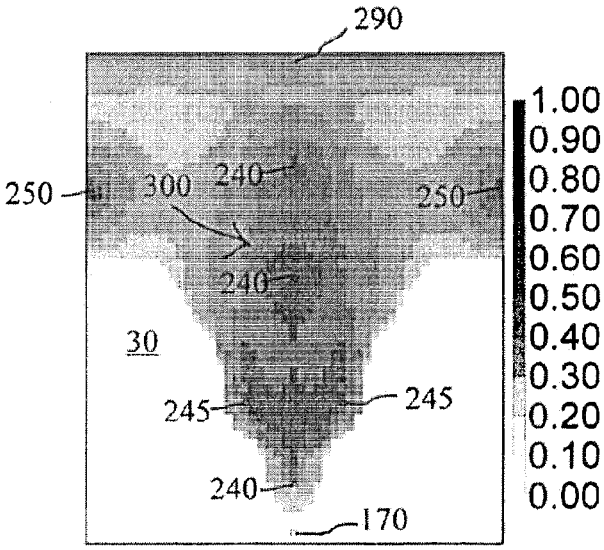
FIG. 13 is a plot of gas saturation in the pattern of FIG. 3 at 7 years.

FIG. 10 is a plot of the bitumen production rate for the first pattern 200 with a portion of the peak production stage indicated at about 7 years. FIGS. 11 to 13 are plots of temperature, viscosity, and gas saturation distributions in the reservoir 30 at 7 years into the simulation.

The average temperature in the reservoir 30 has increased relative to the ramp-up stage. A significant volume of bitumen is at the target average temperature of between about 120° C. and about 160° C. As a result, a mobilized column 280 of bitumen has formed in the reservoir 30 above the heater producer well 170 wherein the viscosity of the bitumen is below 1000 cP and is about 100 cP in much of the mobilized column 280. The aligned heater wells 240, the first offset heater wells 245, and the heater producer well 170 are within the mobilized column 280. A gas chamber 300 comprising evolved solution gas and water vapour has also formed and moves upward as bitumen drains down to the heater producer well 170. The gas chamber 300 provides internal drive and voidage replacement (see below).

Continued heating increases the height and width of the mobilized column 280 with a concurrent increase in bitumen production rate. Peak production occurs due to a favourable combination of pressures and viscosity when the mobilized column 280 has reached a maximum height. The gas chamber 300 has reached a significant size and the aligned heater wells 240 and the first offset heater wells 245 are within the gas chamber 300. During the peak production stage, thermal energy output from the heater wells 10 or the heater producer well 170, or both, may be reduced to maintain the target average temperature of between about 120° C. and about 160° C. in the reservoir 30 without additional increase in temperature to maximize efficiency of energy use.

Production Decline Stage

Figure 14:
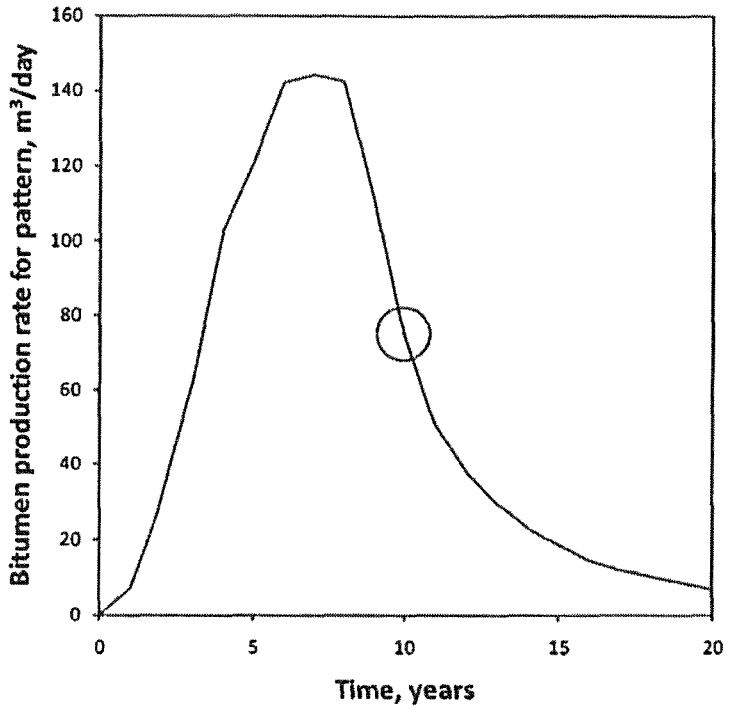
FIG. 14 is a plot of the bitumen production rate versus time with a portion of a production decline stage indicated at about 10 years.
Figure 15:
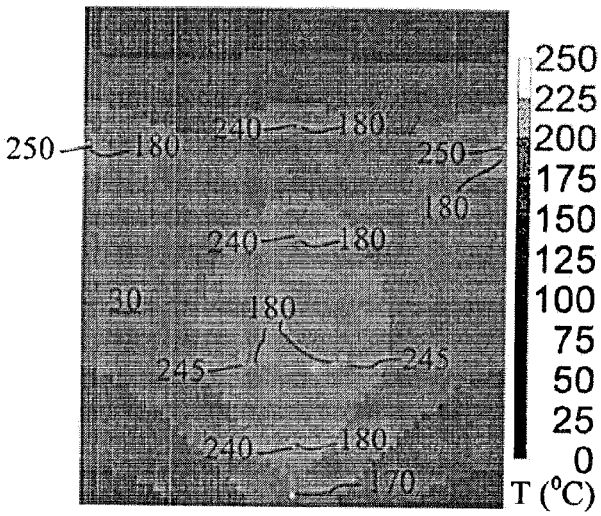
FIG. 15 is a plot of temperature in the pattern of FIG. 3 at 10 years.
Figure 16:
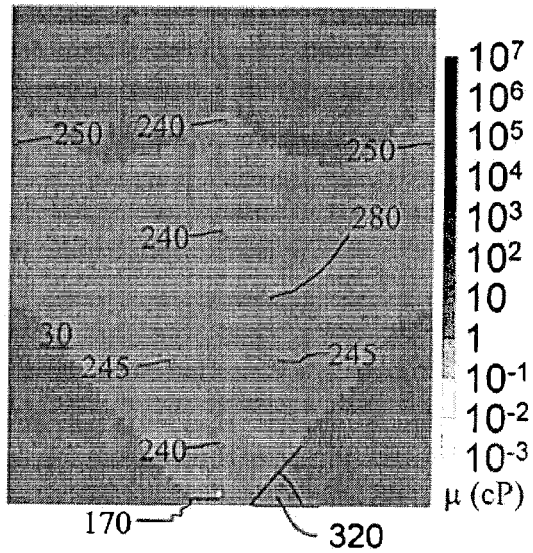
FIG. 16 is a plot of viscosity in the pattern of FIG. 3 at 10 years.
Figure 17:
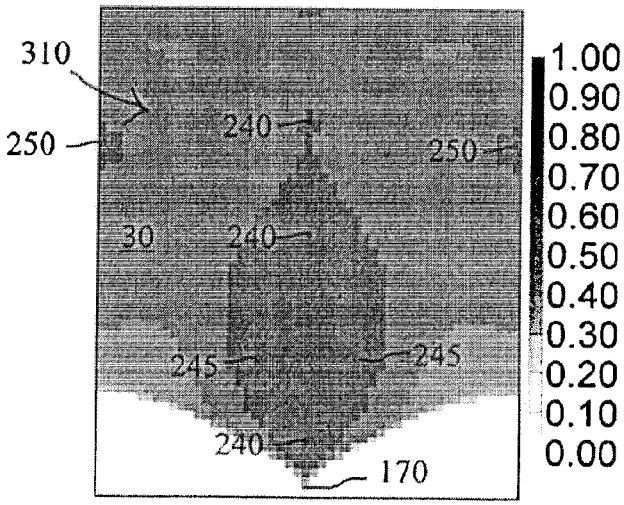
FIG. 17 is a plot of gas saturation in the pattern of FIG. 3 of at 10 years.

FIG. 14 is a plot of the bitumen production rate for the first pattern 200 with a portion of the production decline stage indicated at about 10 years. FIGS. 15 to 17 are plots of temperature, viscosity, and gas saturation distributions at 10 years into the simulation.

During the production decline stage, the majority of the reservoir 30 is at the target average temperature of between about 120° C. and about 160° C. and the majority of the bitumen has a sufficiently low viscosity to be substantially mobile. The gas chamber 300 has merged with the gassy-bitumen zone 290 to form a secondary gas cap 310. The secondary gas cap 310 includes evolved solution gas and water vapour. An angle 320 at which mobilized bitumen drains to the heater producer well 170 becomes increasingly acute to the horizontal. During the production decline stage, the reservoir heaters 80 may be turned down to deliver less thermal energy than during previous stages (FIG. 19), and may even be turned off (not shown). As a result, while the near heater zones 180 remain, the difference in temperature between the near heater zones 180 and the majority of the reservoir 30 is less pronounced. At abandonment, the remaining oil-in-place is contained at near residual saturations within the gas chamber 300, and near the base of the reservoir 30 at an angle 320 that is unfavourably acute to the horizontal with respect to the heater producer well 170.

Summary of Value Indicators Over Time

Figure 18:
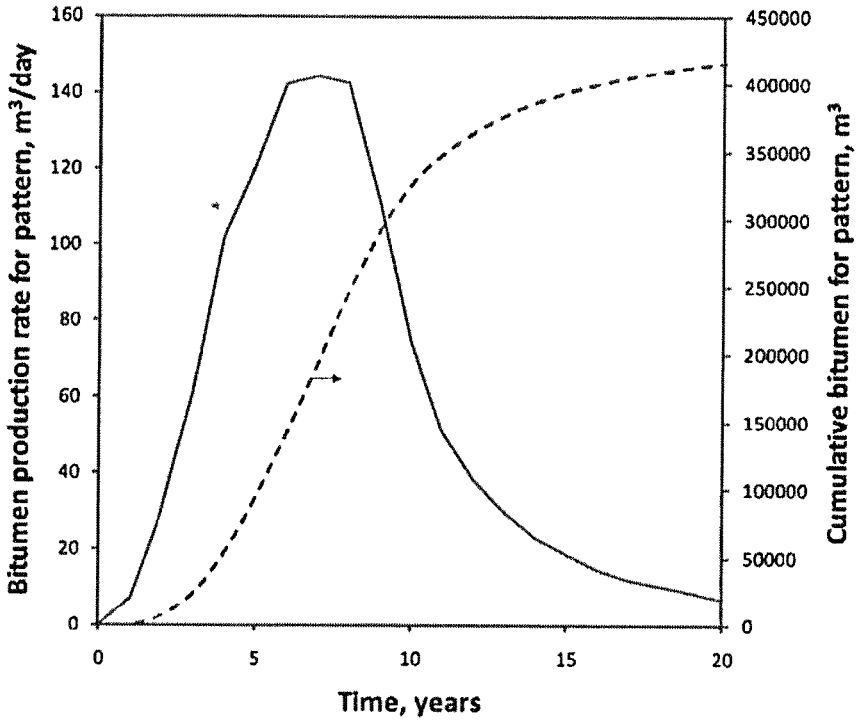
FIG. 18 is a plot of bitumen production rate and cumulative bitumen production versus time for the pattern of FIG. 3.

FIG. 18 is a plot of the bitumen production rate and the cumulative recovered bitumen of the simulation versus time. The peak production rate of 145 $m^3$/day and overall recovery after 20 years is about 69% of OOIP. The peak production rate and overall recovery are comparable to that observed for an average SAGD well pair.

Figure 19:
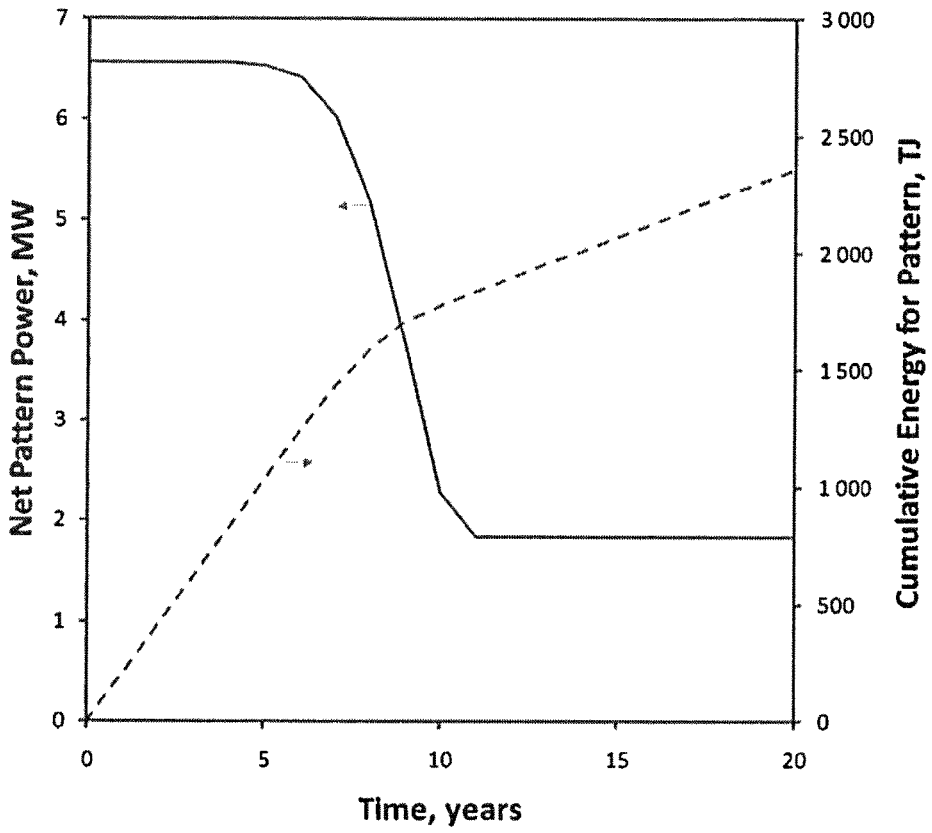
FIG. 19 is a plot of net pattern power and cumulative energy requirements versus time for the pattern of FIG. 3.

FIG. 19 is a plot of the net pattern power and the cumulative energy of the simulation versus time with 650 W/m of power output to the six heater wells 10 and 150 W/m of power output to the heater producer well 170. Each of the heater wells 10 has a 1600 m long heating zone 70 and the heater producer well 170 has a 1600 m long producer heating zone 100. The net pattern power drops and levels off when thermal energy output from the heater wells 10 and the heater producer well 170 is reduced from the above levels. Reduction in thermal energy output allows the target average temperature of between about 120° C. and about 160° C. to be maintained (but not further increased) while using less power.

Figure 20:
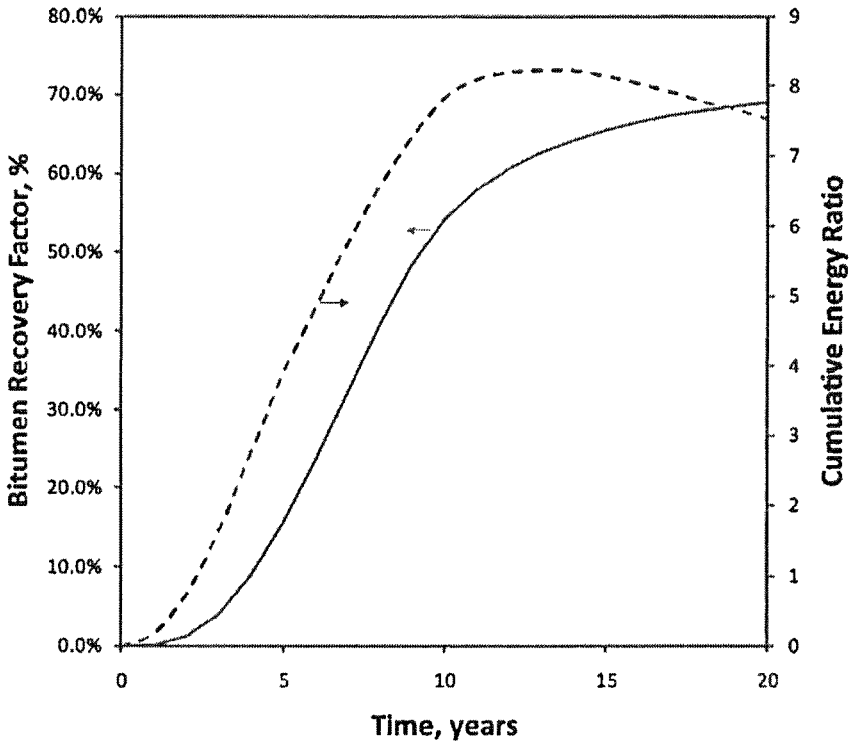
FIG. 20 is a plot of the bitumen recovery factor and cumulative energy ratio versus time for the pattern of FIG. 3.

FIG. 20 is a plot of the bitumen recovery factor and the cumulative energy ratio of the simulation versus time.

Voidage Replacement

To effectively drain hot mobilized bitumen or heavy oil, produced volumes must be replaced to prevent establishment of low reservoir pressures. Low reservoir pressures may prevent economical production. Without wishing to be bound by any theory, the simulation indicates that voidage replacement may occur by a one or more of at least three mechanisms.

First, evolution of solution gas from the bitumen or heavy oil. Solubility of gas in bitumen or heavy oil decreases significantly with increasing temperature. As the bitumen or heavy oil is heated, solution gas evolves from the bitumen or heavy oil. The specific volume of the dissolved gas component is significantly greater in the gas phase than in the solution phase, thus replacing some of the voidage created by production. For example, at 140° C. and 500 kPa (absolute), the specific volume of the solution gas component is about 200 times greater in the gas phase than as a dissolved component in the liquid bitumen or heavy oil phase.

Second, vapourization of connate water in low-pressure reservoirs (for example shallow reservoirs). The specific volume of steam is significantly greater than that of liquid water. At 140° C., the specific volume of saturated steam is about 500 times greater than that of saturated liquid water. A portion of the reservoir 30 will exceed the saturation temperature thus leading to the vapourization of some of the connate water initially in place and thus contributing to voidage replacement. The target average temperature of the reservoir 30 is between about 120° C. and about 160° C., so water may boil where the average temperature of the reservoir 30 is on the upper end of this range and water will boil in the near heater zones 180.

Third, expansion of in-place volumes. Although less significant that the solution gas evolution and vapourization of connate water processes noted above, some voidage replacement will be realized by thermal expansion of in-place hydrocarbons, connate water and free gas. For example, an expansion of about 10% is estimated at 140° C. and 500 kPa (absolute).

Gas Injection

Gas injection into a gassy-bitumen zone 290, a gas cap (not shown), or a gas-bitumen transition zone (not shown) overlying the reservoir 30 at or near the beginning of the ramp-up stage may allow the ramp-up stage to be completed in a shorter time frame. In the simulation, the peak production stage began about two years sooner with gas injection (i.e. at about 5 years instead of about 7 years). Gas injection provides further drive to the gravity drainage process. Gas injection may be stopped once the injected gas begins to break-through to the producer well 20. A variety of non-condensable gases may be used, including natural gas, nitrogen, carbon dioxide, or flue gas.

Advantages of TAGD

The TAGD recovery process has several important advantages over other thermal processes used to recover bitumen or heavy oil (e.g. SAGD, CSS, and hybrid steam injection with solvent).

TAGD allows more uniform and predictable heating of a reservoir relative to steam injection processes. In steam injection processes, transfer of thermal energy is accomplished through convection in which thermal energy is carried throughout the reservoir by fluid flow. Transfer of thermal energy by convection is governed by pressure differential and the effective permeability of the reservoir. The effective permeability may vary by orders of magnitude within a carbonate reservoir. Low permeability layers may block or retard the flow of steam. Steam may also flow preferentially in natural fractures thus bypassing the majority of the reservoir and resulting in poor steam conformance. Poor steam conformance results in poor recovery and high steam-oil ratios, and therefore in unfavourable economics.

Heat conduction is governed largely by a temperature difference and the effective thermal conductivity of a reservoir. The effective thermal conductivity of the reservoir is a function of rock mineralogy, reservoir porosity, and the saturations and thermal conductivities of the fluids in the reservoir, including bitumen or heavy oil, water and gas. In general, unlike reservoir permeability, the variation of thermal conductivity throughout the reservoir is relatively minor and is expected to be less than about plus or minus 25%. The result will be a much more uniform temperature distribution within the reservoir.

TAGD allows more efficient use of input energy. In the SAGD recovery process, the temperature of a reservoir contacted by steam is determined by the reservoir pressure and is generally in excess of 200° C., such as about 260° C. Even higher temperatures are reached during the higher pressure CSS processes, such as about 330° C. By contrast, the target average temperature in TAGD is about 120° C. to about 160° C., thus requiring significantly less input energy, for comparable oil recovery (e.g. production rate or recovery factor, or both), than the processes based on steam injection.

TAGD does not require steam injection and therefore does not require water for steam generation. This may be an important advantage in field locations where a source of available water is absent or is costly to develop. The simulation indicates that produced water-oil ratios may be less than 0.5 $m^3/m^3$ after year 3 of production. In contrast, steam-based processes produce at water-oil ratios on the order of 3.0 $m^3/m^3$ (or 3:1). The initial water-oil ratio in TAGD is a function of the mobility of water present in the reservoir prior to heating, and may vary from reservoir to reservoir. In addition to lowered water use, this advantage also provides the benefit of allowing processing facilities for produced bitumen to be smaller, simpler in design, and less expensive to build.

At the target average reservoir temperature of between about 120° C. and about 160° C., little or no generation of $H_2S$ or $CO_2$ is expected. Thus, less $H_2S$ and less $CO_2$ is produced per unit of produced bitumen or heavy oil than for a typical SAGD project.

TAGD may be used to supplement existing SAGD operations or may be used as a retrofit existing SAGD well bores.

In the preceding description, for purposes of explanation, numerous details are set forth in order to provide a thorough understanding of the embodiments. However, it will be apparent to one skilled in the art that these specific details are not required. The above-described embodiments are intended to be examples only. Alterations, modifications and variations can be effected to the particular embodiments by those of skill in the art without departing from the scope, which is defined solely by the claims appended hereto.

What is claimed is:

1. A method of producing bitumen or heavy oil from a reservoir comprising:

a) providing a horizontal producer well adjacent to a lower boundary of a cross-sectional area of the reservoir and substantially centered between two vertical no-flow boundaries within a cross-sectional area of the reservoir;

b) providing a plurality of vertically distributed rows of horizontal heater wells in the reservoir above the producer well, the plurality of rows including a first row with a single aligned heater well substantially vertically aligned and parallel with the producer well and a second row above the first row including at least two offset heater wells laterally offset and substantially equidistant from the producer well;

c) activating the heater wells to conductively heat the reservoir and reduce the viscosity of the bitumen or heavy oil;

d) allowing the bitumen or heavy oil to drain by gravity into the producer well; and e) producing the bitumen or heavy oil with the producer well.

2. The method of claim 1 further comprising:

providing a reservoir producer heater in the producer well; and operating the reservoir producer heater to conductively heat the reservoir and reduce the viscosity of the bitumen or heavy oil.

3. The method of claim 1 further comprising:

providing a reservoir producer heater in a vertical section of the producer well; and operating the reservoir producer heater to facilitate flow of the bitumen or heavy oil in the producer well upstream to the well head.

4. The method of claim 1, wherein the reservoir is heated to an average temperature of less than the thermal cracking temperature of the bitumen or heavy oil in the reservoir at reservoir conditions.

5. The method of claim 1, wherein the reservoir is heated to a temperature less than the saturated steam temperature at reservoir conditions.

6. The method of claim 1 wherein the reservoir is heated to an average temperature of between about 120° C. and about 160° C.

7. The method of claim 1 wherein the reservoir is heated to an average temperature of between about 135° C. and about 145° C.

8. The method of claim 1 wherein the reservoir is a clastic reservoir.

9. The method of claim 1 wherein the reservoir is a carbonate reservoir.

10. The method of claim 9 wherein the reservoir is a dolomite reservoir.

11. The method of claim 9 wherein the reservoir is a limestone reservoir.

12. The method of claim 9 wherein the reservoir is a karsted reservoir.

13. The method of claim 9 wherein the reservoir is a vuggy reservoir.

14. The method of claim 9 wherein the reservoir is a moldic reservoir.

15. The method of claim 9 wherein the reservoir is a fractured reservoir.

16. The method of claim 1 further comprising:

selecting a target average temperature; and reducing heating of the heater wells once the average temperature of the reservoir is substantially equal to the target average temperature to maintain the average temperature of the reservoir at the target average temperature without increasing the average temperature of the reservoir.

17. The method of claim 16 wherein the target average temperature is between about 120° C. and about 160° C.

18. The method of claim 17 wherein the target average temperature is between about 135° C. and about 145° C.

19. The method of claim 1 further comprising controlling pressure during production to prevent an increase in pressure due to thermal expansion of in situ fluids.

20. The method of claim 19 wherein the pressure is controlled by drawing down pressure from the reservoir.

21. The method of claim 1 wherein the plurality of vertically distributed rows of horizontal heater wells further includes at least one additional row with a single aligned heater well substantially aligned with and parallel to the producer well, to keep the area near the producer sufficiently warm to allow drainage of the bitumen or heavy oil into the producer well and at least one additional row including at least two offset heater wells laterally offset and substantially equidistant from the producer well.

22. The method of claim 21 wherein the rows with a single aligned heater well alternate with the rows of offset heater wells.

23. The method of claim 21 wherein the plurality of vertically distributed rows of horizontal heater wells includes at least two rows with a single aligned heater well and at least two rows with offset heater wells.

24. The method of claim 23 wherein the rows with an aligned heater well alternate with the rows of offset heater wells.

25. The method of claim 23 wherein the distance between the two offset heater wells of the same row varies among different rows of offset heater wells.

26. The method of claim 1 wherein at least one row of offset heater wells includes one offset heater well located substantially at or adjacent to each no-flow vertical boundary of the cross-sectional area of the reservoir.

27. The method of claim 1 wherein at least one row of offset heater wells further includes a heater well substantially laterally aligned with the producer well, to provide sufficient heating to promote drainage of the bitumen or heavy oil above the producer well.

28. The method of claim 1 wherein the plurality of rows of heater wells includes three rows of heater wells with one aligned heater well row and two offset heater well rows.

29. The method of claim 28 wherein the three rows of heater wells follows a pattern wherein:

the first row above the producer well includes a single aligned heater well, the second row above the producer well includes two offset heater wells, and the third row above the producer well includes two offset heater wells and a single aligned heater well.

30. The method of claim 28 wherein the vertical distance between adjacent rows is between about 8 m to about 15 m.

31. The method of claim 29 wherein the distance between offset heater wells in the same row is between about 12 m to about 40 m.

32. The method of claim 29 wherein the reservoir has a thickness of about 40 m.

33. The method of claim 1 wherein the plurality of rows of heater wells includes five rows of heater wells with three aligned heater well rows and two offset heater well rows.

34. The method of claim 33 wherein the five rows of heater wells follows a pattern wherein:

the first row above the producer well includes a single aligned heater well, the second row above the producer well includes two offset heater wells, the third row above the producer well includes a single aligned heater well, the fourth row above the producer well includes two offset heater wells, and the fifth row above the producer well includes a single aligned heater well.

35. The method of claim 34 wherein the vertical distance between adjacent rows is between about 2 m to about 15 m.

36. The method of claim 34 wherein the distance between offset heater wells in the same row is between about 12 m to about 50 m.

37. The method of claim 34 wherein the reservoir has a thickness of about 60 m.

38. The method of claim 1 wherein the plurality of rows of heater wells includes six rows of heater wells with three aligned heater well rows and three offset heater well rows.

39. The method of claim 38 wherein the six rows of heater wells follows a pattern wherein:

the first row above the producer well includes a single aligned heater well, the second row above the producer well includes two offset heater wells, the third row above the producer well includes a single aligned heater well, the fourth row above the producer well includes two offset heater wells, the fifth row above the producer well includes a single aligned heater well, and the sixth row above the producer well includes two offset heater wells.

40. The method of claim 39 wherein the vertical distance between adjacent rows is between about 4 m to about 14 m.

41. The method of claim 39 wherein the distance between offset heater wells in the same row is between about 12 m to about 50 m.

42. The method of claim 39 wherein the reservoir has a thickness of about 80 m.

43. The method of claim 1 wherein the heater wells are heated by an electric resistance cable heater, a fluid exchange heater, hot water, steam, oil, molten salts, or molten metals.

44. The method of claim 1 wherein step c) generates gas through solution gas evolution and connate water vaporization to replace voidage created by step e).

45. The method of claim 1 wherein step d) further comprises injecting gas into a zone overlying the reservoir.

* * * * *

UNITED STATES PATENT AND TRADEMARK OFFICE

CERTIFICATE OF CORRECTION

PATENT NO. : 9,051,828 B2
APPLICATION NO. : 13/163009
DATED : June 9, 2015
INVENTOR(S) : Gould et al.

It is certified that error appears in the above-identified patent and that said Letters Patent is hereby corrected as shown below:

Title Page

In the Assignee (73): Delete "Athabasca Oil Sands Corp." and insert --Athabasca Oil Corporation--

Signed and Sealed this
Tenth Day of November, 2015

Michelle K. Lee

Michelle K. Lee
*Director of the United States Patent and Trademark Office*

UNITED STATES PATENT AND TRADEMARK OFFICE

CERTIFICATE OF CORRECTION

PATENT NO. : 9,051,828 B2
APPLICATION NO. : 13/163009
DATED : June 9, 2015
INVENTOR(S) : Gould et al.

It is certified that error appears in the above-identified patent and that said Letters Patent is hereby corrected as shown below:

In the Claims

Column 13, Line 36: Claim 30, Delete "claim 28" and insert -- claim 29 --

Signed and Sealed this
Twelfth Day of January, 2016

Michelle K. Lee

Michelle K. Lee
*Director of the United States Patent and Trademark Office*